US011583986B2

(12) United States Patent
Wu et al.

(10) Patent No.: US 11,583,986 B2
(45) Date of Patent: Feb. 21, 2023

(54) AIR-PATH STRUCTURE OF PNEUMATIC NAIL GUN

(71) Applicant: De Poan Pneumatic Corp., New Taipei (TW)

(72) Inventors: I-Tsung Wu, New Taipei (TW); Chia-Sheng Liang, New Taipei (TW); Hai-Lun Ma, New Taipei (TW); Kai-Peng Hsien, New Taipei (TW)

(73) Assignee: DE POAN PNEUMATIC CORP., New Taipei (TW)

( * ) Notice: Subject to any disclaimer, the term of this patent is extended or adjusted under 35 U.S.C. 154(b) by 103 days.

(21) Appl. No.: 17/201,489

(22) Filed: Mar. 15, 2021

(65) Prior Publication Data

US 2021/0291334 A1 Sep. 23, 2021

(30) Foreign Application Priority Data

Mar. 18, 2020 (TW) ..... 109109007
Mar. 18, 2020 (TW) ..... 109109009

(51) Int. Cl.
*B25C 1/04* (2006.01)
*B25C 1/00* (2006.01)

(52) U.S. Cl.
CPC ..... *B25C 1/008* (2013.01); *B25C 1/043* (2013.01)

(58) Field of Classification Search
CPC ..... B25C 1/008; B25C 1/043; B25C 1/046
See application file for complete search history.

(56) References Cited

U.S. PATENT DOCUMENTS 11,185,967 B2 * 11/2021 Oouchi ..... B25C 1/042
2008/0272169 A1 * 11/2008 Liang ..... B25C 1/043 227/130
2010/0012698 A1 * 1/2010 Liang ..... B25C 1/043 227/8
2021/0138621 A1 * 5/2021 Theberath ..... B25C 1/008
2022/0143797 A1 * 5/2022 Ishizawa ..... B25C 1/047
2022/0219300 A1 * 7/2022 Tanaka ..... B25C 1/047

FOREIGN PATENT DOCUMENTS

EP 3960378 A1 * 3/2022
WO WO-2019171809 A1 * 9/2019

* cited by examiner

*Primary Examiner* — Thanh K Truong
*Assistant Examiner* — Joy N Sanders
(74) *Attorney, Agent, or Firm* — Chun-Ming Shih; HDLS IPR Services

(57) ABSTRACT

An air-path structure of a pneumatic nail gun includes a main chamber formed in a gun body, a piston driving chamber and a timekeeping chamber that continuously releases pressurized air to the outside. The gun body is equipped with a trigger valve and a bar valve, and a security chamber and an auxiliary chamber are formed in the trigger valve; the trigger valve controls the pressurized air in the piston driving chamber to be discharged to the outside; and the bar valve controls the pressurized air in the main chamber to go into the piston driving chamber, the timekeeping chamber and the auxiliary chamber. The security chamber is permanently connected to the main chamber for concentrating upon the pressurized air, and the bar valve controls the pressurized air in the main chamber to be discharged into the timekeeping chamber, so as to improve the safety of pneumatic nail gun when used.

12 Claims, 12 Drawing Sheets

AIR-PATH STRUCTURE OF PNEUMATIC NAIL GUN

BACKGROUND OF INVENTION

1. Field of the Invention

The present invention relates generally to the structural configuration of a pneumatic nail gun, and more particularly to an air-path structure of a pneumatic nail gun.

2. Description of Related Art

A pneumatic nail gun is a pneumatic hand tool that is powered by pressurized air to drive the piston to go downward to shoot the nail and go upward for resetting. Normally, based on the safety operation sequence when a user uses the pneumatic nail gun to shoot nails, it is divided into two types: sequential actuation mode and contact actuation mode, wherein:

In the case of the sequential actuation mode, the user must contact the safety bar or the striking seat on the bar with the work piece to be nailed before pressing the trigger to actuate the trigger valve to shoot the nail. In this mode, when a second shot is needed, the user must operate in a preset sequence to release the trigger first and then press the trigger again to make a second shot. If the users violate this operation sequence, and press the trigger first and then press the safety bar or the striking seat on the bar, the trigger valve cannot be actuated, and the pneumatic nail gun cannot shoot the nail. Hence, the sequential actuation mode can ensure safety when the user operates the pneumatic nail gun.

In the case of the contact actuation mode, the user firstly keeps pressing on the trigger with no release, and then direct the safety bar or the striking seat on the bar to the work piece to be nailed for continuous striking with direct contact, and the trigger valve is actuated upon every striking for continuous nail shooting with direct contact. In this mode, the user is also allowed to firstly press the safety bar or the striking seat on the bar on the work piece to be nailed, and then the trigger is pressed just once or continuously to shoot one or more nails. Hence, although the contact actuation mode provides the convenience of continuous nailing when the user operates the pneumatic nail gun, it poses a higher risk of mistaken nailing comparing to the sequential actuation mode.

In the conventional pneumatic nail guns, for the purpose of shifting the aforesaid sequential actuation mode and contact actuation mode, the pneumatic nail gun is configured with a manual shifting valve stem, so that the user can shift between different nailing modes. However, the shifting device can increase the structural complexity of the pneumatic nail gun (including the air path), and the manual shifting valve stem no longer meets the standards of new safety rules for nail guns.

More specifically, new safety rules for nail guns tend to standardize the operation of nail guns that the pneumatic nail gun must be started from the sequential actuation mode, i.e., the user must firstly press the safety bar (or the striking seat on the bar) on the work piece to be nailed before pressing the trigger for a single shot. Moreover, through the operation of a safety bar, the time to start the contact actuation mode is further standardized to enhance the operational safety of nail guns. However, by now the technology in this industry is still immature.

SUMMARY OF THE INVENTION

The object of the present invention is to improve the operational safety of conventional pneumatic nail guns.

More specifically, while meeting the standards of new safety rules for nail guns, the invention removes configuration of the manual shifting valve stem for shifting sequential actuation mode and contact actuation mode; in particular, the present invention uses the sliding of the safety bar as the starting point of control, and combing the operation habit of users, the nailing modes are shifted in a safer manner. Moreover, the present invention also incorporates a safety mode that the nail gun can automatically return to the preset nailing mode when there is no operation within a preset time period, thus improving the operational safety of the nail gun.

To realize the above object, the invention provides an air-path structure of a pneumatic nail gun, comprising: a gun body, having a main chamber for concentrating upon pressurized air, a piston driving chamber and a timekeeping chamber that continuously releases the pressurized air to the outside; a trigger valve, configured on the gun body, the trigger valve includes a ring-shaped shuttle valve, a security chamber and an auxiliary chamber, the two ends of the ring-shaped shuttle valve are respectively exposed in the security chamber and the main chamber, and the ring-shaped shuttle valve goes through the auxiliary chamber, the pressurized air inside the security chamber forms a first thrust, the pressurized air inside the main chamber forms a second thrust, the pressurized air inside the auxiliary chamber forms a third thrust, the first thrust, the second thrust and the third thrust respectively acts upon the ring-shaped shuttle valve, and the second thrust and the third thrust are directed opposite to the first thrust, the trigger valve controls the pressurized air inside the piston driving chamber through the ring-shaped shuttle valve to be released out of the gun body; a bar valve, configured on the gun body, the bar valve controls the pressurized air inside the main chamber to be released to the piston driving chamber, the timekeeping chamber and the auxiliary chamber; wherein, the security chamber is permanently connected to the main chamber for concentrating upon the pressurized air, and the pressurized air inside the auxiliary chamber goes to the timekeeping chamber through the bar valve and be released to the outside, so that the first thrust is stronger than the sum of the second thrust and the third thrust, and can drive the ring-shaped shuttle valve to move to a security unlock-position; the pressurized air inside the main chamber goes through the bar valve to the auxiliary chamber, so that the sum of the third thrust and the second thrust formed by the pressurized air concentrated inside the auxiliary chamber is stronger than the first thrust, and can drive the ring-shaped shuttle valve to move from the security unlock-position to a security lock-position.

In one embodiment, the gun body is formed with an intake path, the two ends of the intake path respectively extend to the main chamber and the security chamber, the pressurized air inside the main chamber goes through the intake path to the security chamber.

In one embodiment, the trigger valve also includes a trigger valve seat and a trigger valve stem, the trigger valve seat is located at the bottom of the trigger valve, and is fitted on the gun body, the trigger valve stem goes through the trigger valve seat and is planted inside the ring-shaped shuttle valve, the security chamber is formed between the ring-shaped shuttle valve and the trigger valve seat, the auxiliary chamber is formed between the gun body and the ring-shaped shuttle valve. In particular, the ring-shaped shuttle valve has a first surface, a second surface and a third surface, the first surface is exposed in the security chamber, the second surface is exposed in the main chamber, the third surface is exposed in the auxiliary chamber, the first surface has a thrust area contacting the pressurized air relatively larger than that of the second surface, and the sum of the thrust areas of the second surface and the third surface contacting the pressurized air is relatively larger than that of the first surface. Between the ring-shaped shuttle valve and the trigger valve stem, a first valve part of the trigger valve and a second valve part of the trigger valve are formed, the ring wall of the ring-shaped shuttle valve a first hole that is connected to the bar valve, a second hole that is connected to the outside, a third hole that is connected to the bar valve and a fourth hole that is connected to the bar valve, the time of connection between the first hole and the second hole is controlled by the first valve part of the trigger valve, the time of connection between the third hole and the fourth hole is controlled by the second valve part of the trigger valve. The first valve part of the trigger valve and the second valve part of the trigger valve are respectively formed between the ring-shaped shuttle valve and the trigger valve stem sequentially along the axial direction of the ring-shaped shuttle valve, and the first hole, the second hole, the third hole and the fourth hole are respectively formed on the ring wall of the ring-shaped shuttle valve sequentially along the axial direction of the ring-shaped shuttle valve.

In one embodiment, the gun body is formed with a bar valve chamber, the bar valve comprises a safety bar slidably fitted in the bar valve chamber, one end of the safety bar protrudes out of the gun body, the other end of the safety bar is planted inside the main chamber. In particular, between the bar valve chamber and the safety bar, a first valve part of the bar valve, a second valve part of the bar valve and a third valve part of the bar valve are respectively formed, and the wall surface of the bar valve chamber is formed with a first path connected to the piston driving chamber, a second path connected to the trigger valve, a third path connected to the timekeeping chamber, a fourth path connected to the trigger valve and a fifth path connected to the main chamber, the time of connection between the main chamber and the first path is controlled by the first valve part of the bar valve, the time of connection between the first path and the second path is meanwhile controlled by the first valve part of the bar valve, the time of connection between the third path and the fourth path is controlled by the second valve part of the bar valve, the third path, the time of connection between the fourth path and the fifth path is controlled by the third valve part of the bar valve. The first valve part of the bar valve, the second valve part of the bar valve and the third valve part of the bar valve are respectively formed between the bar valve chamber and the safety bar sequentially along the axial direction of the bar valve chamber, the first path, the second path, the third path, the fourth path and the fifth path are respectively formed on the wall surface of the bar valve chamber sequentially along the axial direction of the bar valve chamber.

In one embodiment, one end of the gun body is formed with a decompress hole connected to the timekeeping chamber, the pressurized air inside the timekeeping chamber is continuously released to the outside through the decompress hole. In particular, the sectional area of the timekeeping chamber is relatively larger than the decompress hole. One end of the gun body is also formed with an exhaust hole connected to the timekeeping chamber and a press-bar that controls the connection of the exhaust hole to the outside, the sectional area of the exhaust hole is relatively larger than the decompress hole.

Based on the above structural design, the present invention offers the following technical function: either at the first time of using the pneumatic nail gun or when the safety bar has not been pressed within a specific period of time, the user must press the safety bar to start the nailing operation. In this way, the safety of using the pneumatic nail gun is enhanced. Moreover, as the shifting device is no longer needed, the structure of the pneumatic nail gun becomes less complicated.

The features and technical effects disclosed will be readily understood through the following descriptions and accompanying figures.

DETAILED DESCRIPTION OF THE INVENTION

Figure 1:
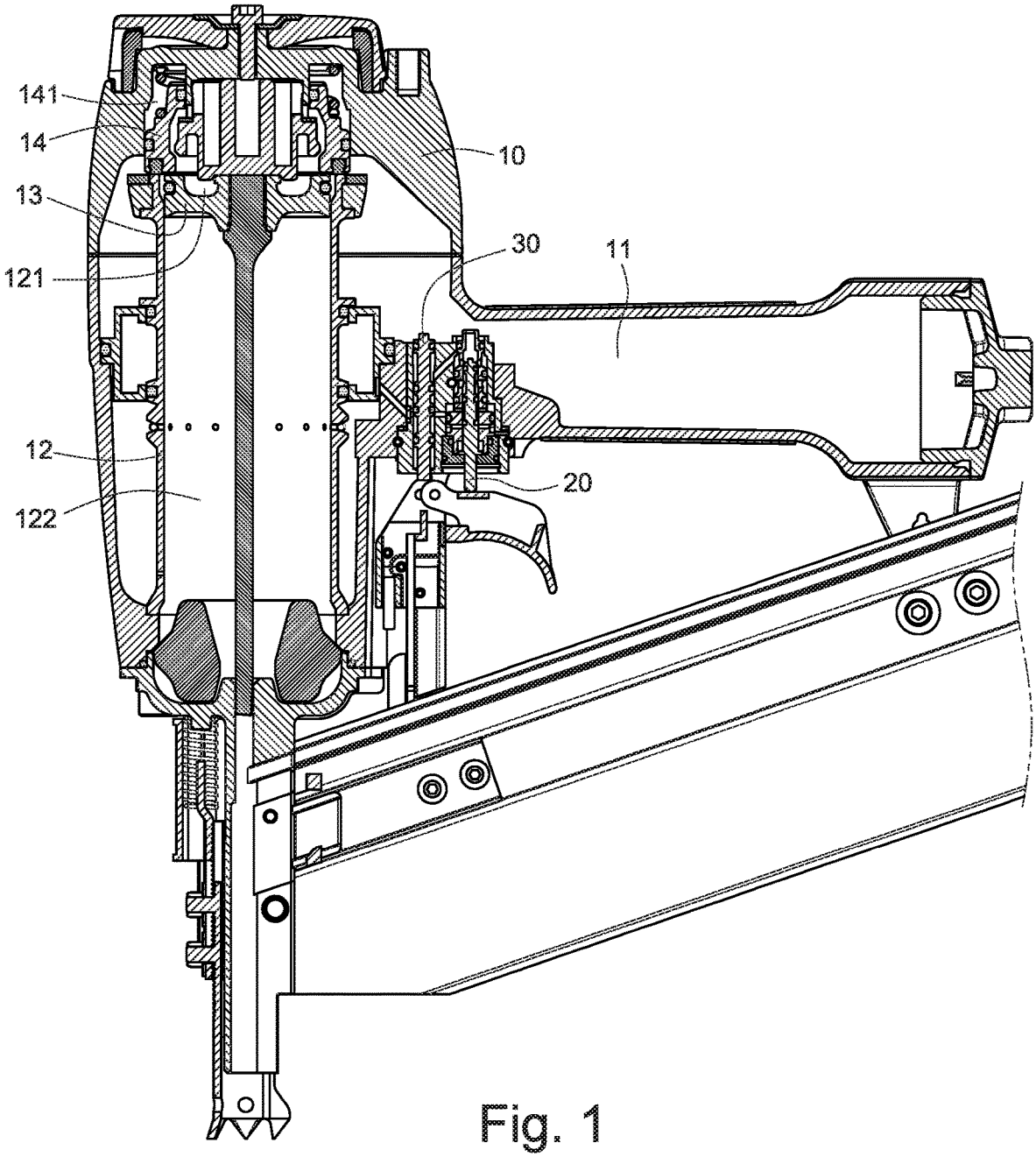
FIG. 1 is a sectional view of a pneumatic nail gun as an example.
Figure 2:
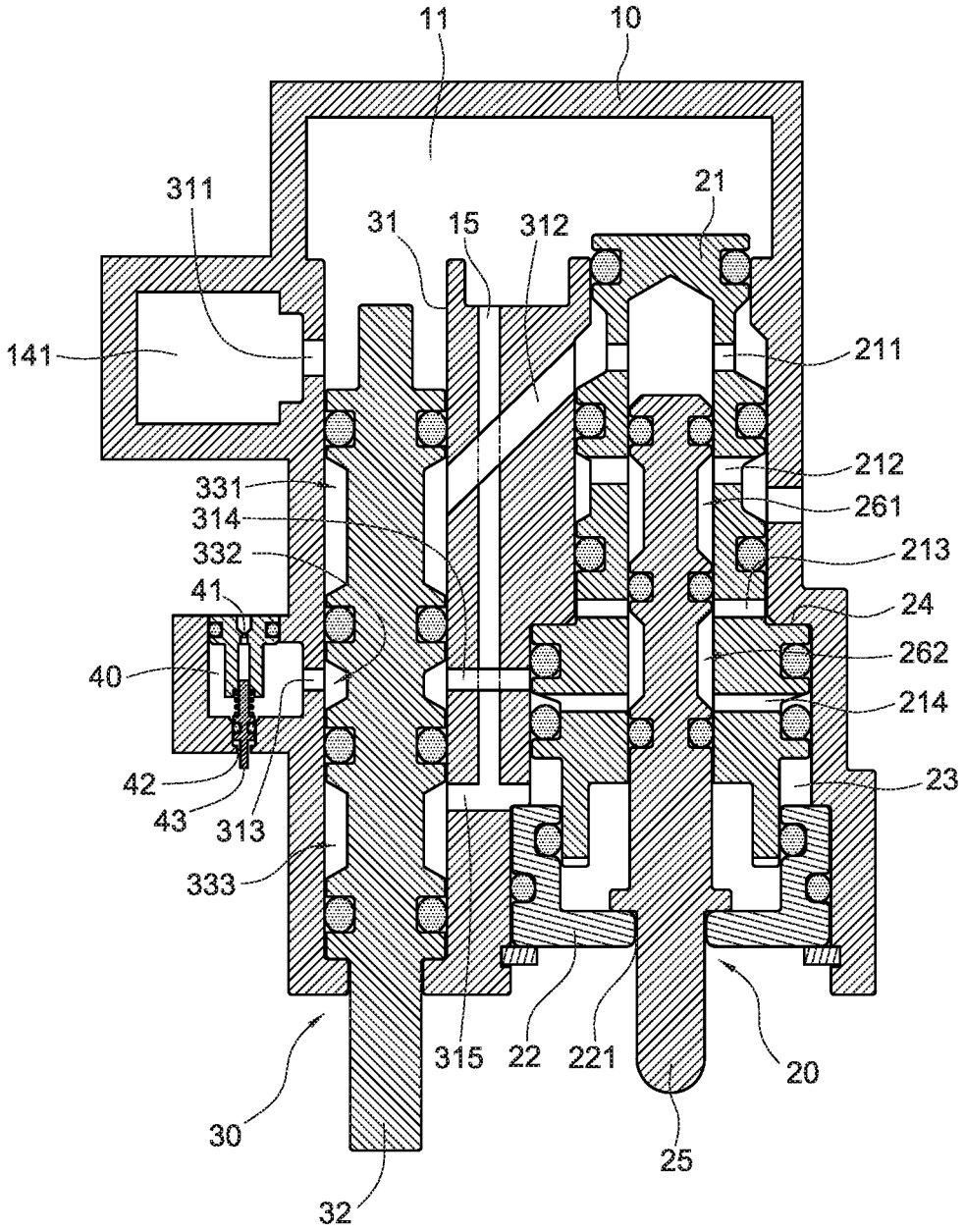
FIG. 2 is a configuration view of the present invention of an air-path structure of a pneumatic nail gun.

Referring collectively to FIG. 1 and FIG. 2, which discloses and describes the configuration details of a preferred embodiment of the present invention, the air-path structure of a pneumatic nail gun disclosed in the invention comprises a gun body 10, a trigger valve 20 and a bar valve 30, wherein:

The gun body 10 is configured with a cylinder 12, and the cylinder 12 is configured with a firing valve 13 capable of sliding. The firing valve 13 separates the inside of the cylinder 12 into a top cylinder chamber 121 and a bottom cylinder chamber 122 with changeable volumes; the top part of the cylinder 12 is configured with a flexible disc piston 14 loaded with spring force. It is not necessary that the disc piston 14 is in the shape of a round disc, it can also be, for example, rectangular or in other shapes; specifically, as long as it is used to control the time when the pressurized air inside the gun body 10 to enter the cylinder 12 (including the top cylinder chamber 121 or the bottom cylinder chamber 122), and to appropriately drive the firing valve 13 to shoot nails, it is covered by the definition of the disc piston 14 of the present invention. The top part of the disc piston 14 is formed with a piston driving chamber 141, the gun body 10 is formed with a main chamber 11 for concentration of the pressurized air, the main chamber 11 surrounds the periphery of the cylinder 12 and the disc piston 14; the inside of the gun body 10 is also formed with a timekeeping chamber 40, the timekeeping chamber 40 can continuously release the pressurized air to the outside.

Figure 2A:
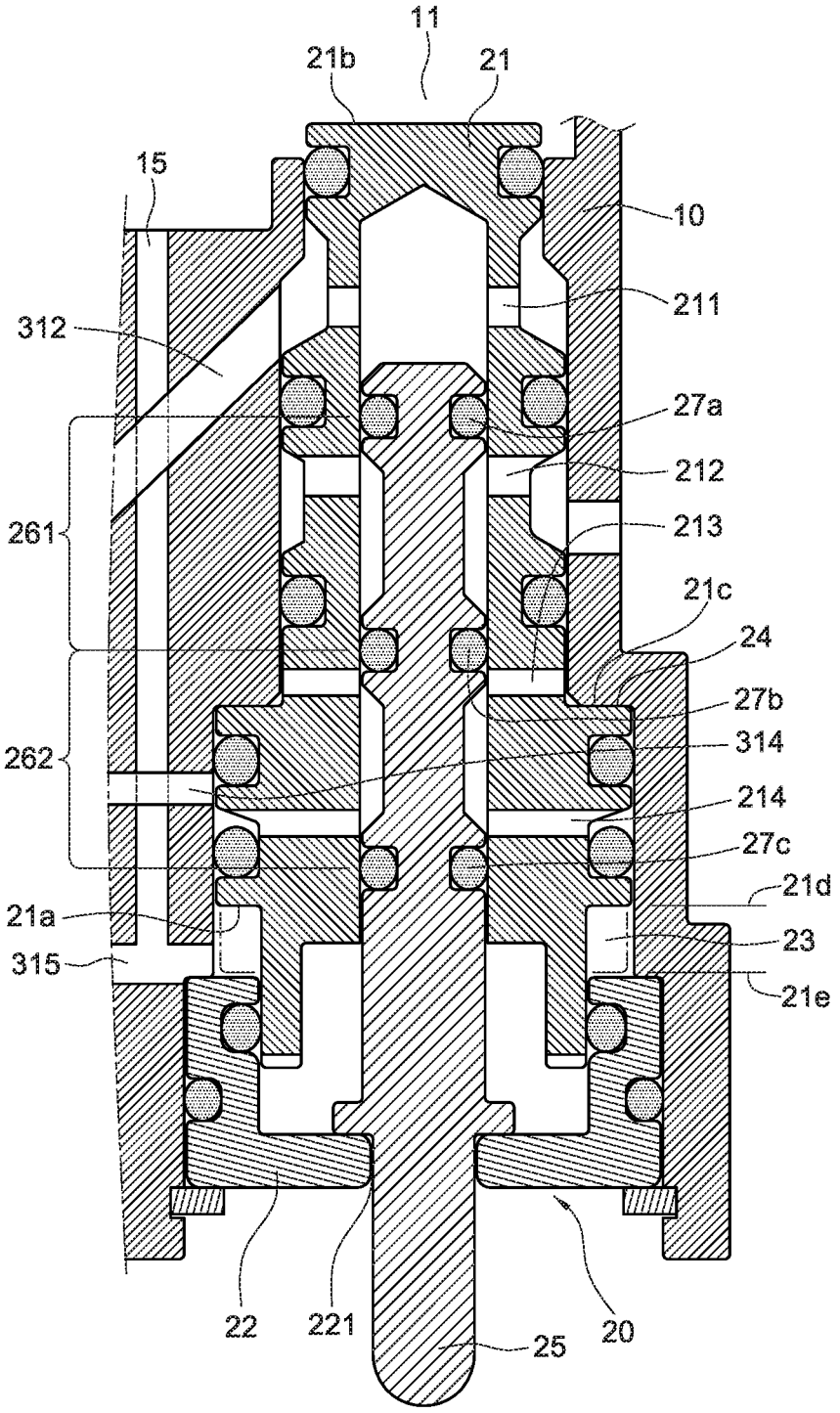
FIG. 2*a* and FIG. 2*b* are respectively partial enlarged views of FIG. 2.

Referring to FIG. 2 and FIG. 2*a* collectively, the trigger valve 20 is configured on the gun body 10, the trigger valve 20 comprises a ring-shaped shuttle valve 21, a trigger valve seat 22 and a trigger valve stem 25, wherein the trigger valve seat 22 is located at the bottom of the trigger valve 20, and is fitted on the gun body 10, the bottom of the trigger valve seat 22 is formed with a stem hole 221, one end of the trigger valve stem 25 goes from the stem hole 221 and through the trigger valve seat 22, and is exposed outside the gun body 10, for pressing by the finger of a user or by the press-bar of an automatic device, the ring-shaped shuttle valve 21 is slidably fitted on the other end of the trigger valve stem 25. The two ends of the ring-shaped shuttle valve 21 are respectively exposed in the main chamber 11 and a security chamber 23, the security chamber 23 is formed between the ring-shaped shuttle valve 21 and the trigger valve seat 22, and the ring-shaped shuttle valve 21 goes through an auxiliary chamber 24, the auxiliary chamber 24 is formed between the gun body 10 and the ring-shaped shuttle valve 21. In implementation, the ring-shaped shuttle valve 21 is driven by the pressurized air inside the main chamber 11, the security chamber 23 and the auxiliary chamber 24 and moves along the axial direction of the trigger valve stem 25, so that the ring-shaped shuttle valve 21 can control the pressurized air inside the piston driving chamber 141 to be released out of the gun body 10. The inside of the gun body 10 is formed with an intake path 15, the two ends of the intake path 15 respectively extends to the main chamber 11 and the security chamber 23, so that, under the normal condition, through the intake path 15, the pressurized air inside the main chamber 11 is continuously introduced into the security chamber 23, and the security chamber 23 has constant concentration of pressurized air.

Further, the ring-shaped shuttle valve 21 has a first surface 21*a*, a second surface 21*b* and a third surface 21*c*, the third surface 21*c* is located between a first surface 21*a* and a second surface 21*b*, wherein the first surface 21*a* is exposed in the security chamber 23, the second surface 21*b* is exposed in the main chamber 11, and the third surface 21*c* is exposed in the auxiliary chamber 24. The ring-shaped shuttle valve 21 can be driven by the pressurized air inside the security chamber 23 received by the first surface 21*a* and move along the axial direction of the trigger valve stem 25 to a security unlock-position 21*d*, or driven by the pressurized air inside the main chamber 11 received by the second surface 21*b* and driven by the pressurized air inside the auxiliary chamber 24 received by the third surface 21*c* and move along the axial direction of the trigger valve stem 25 to a security lock-position 21*e*.

Figure 3:
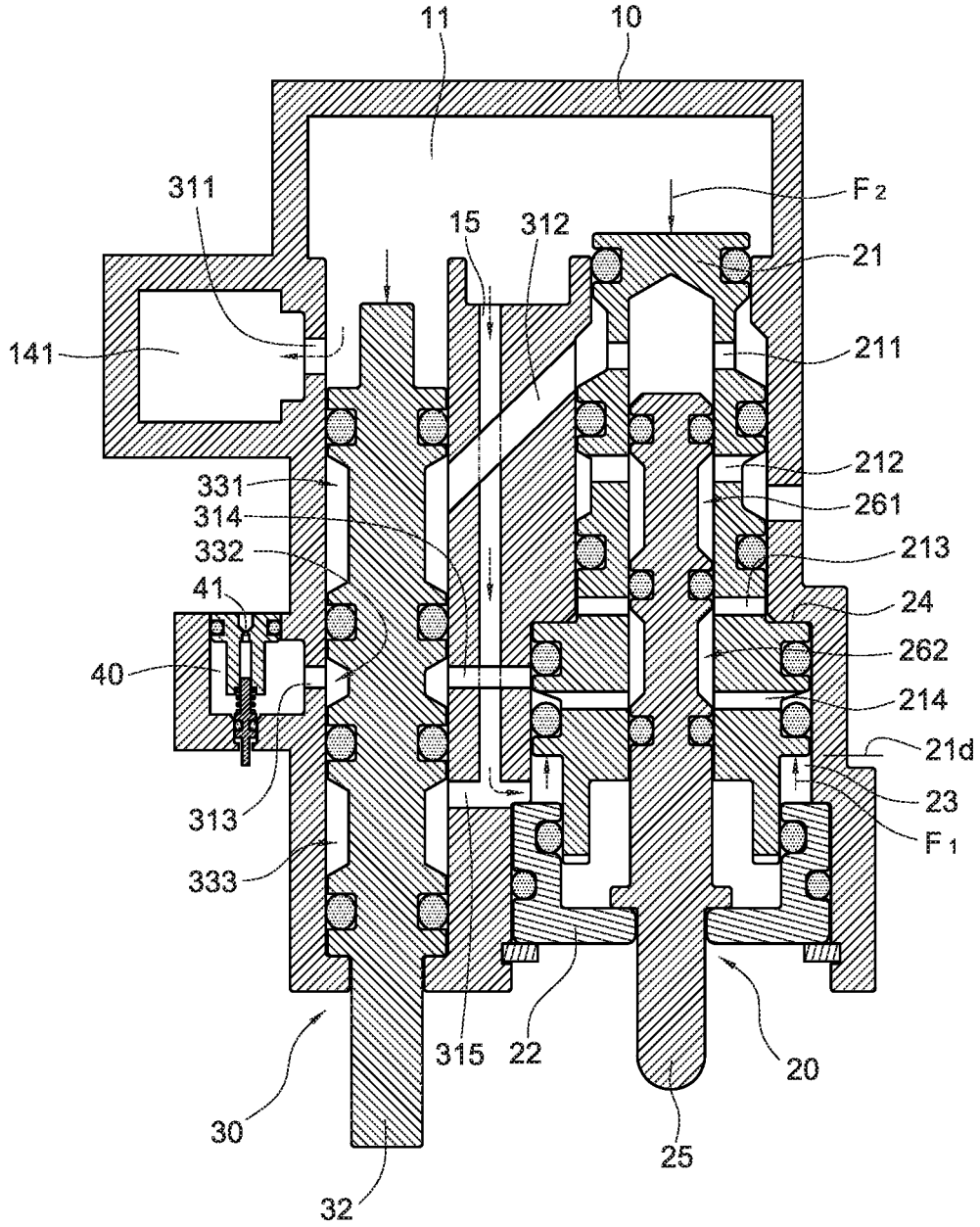
FIG. 3 to FIG. 8 are sequentially the explanation figures showing the continuous actions firstly pressing the safety bar and then pressing the trigger valve stem.
Figure 4:
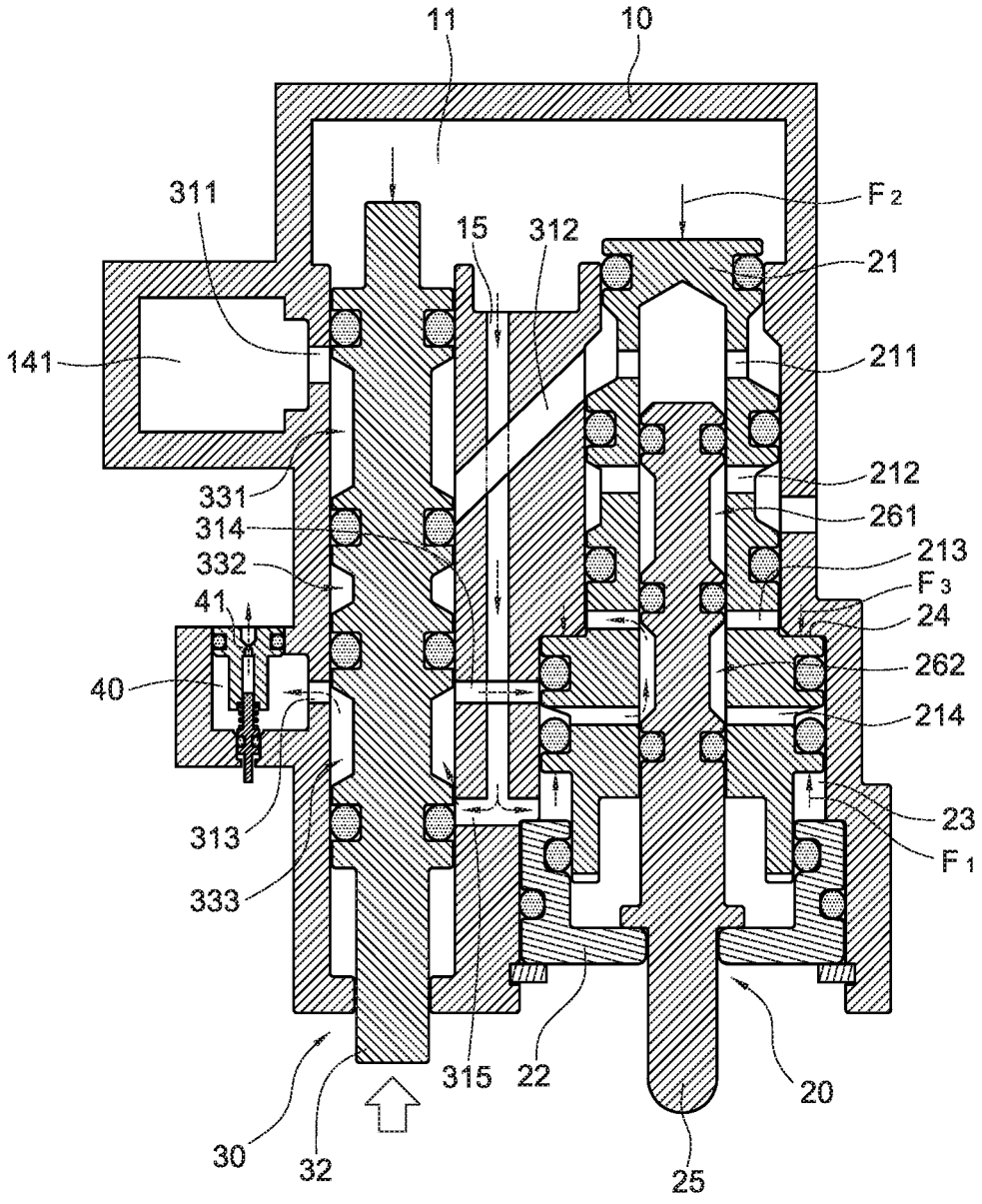
Figure 5:
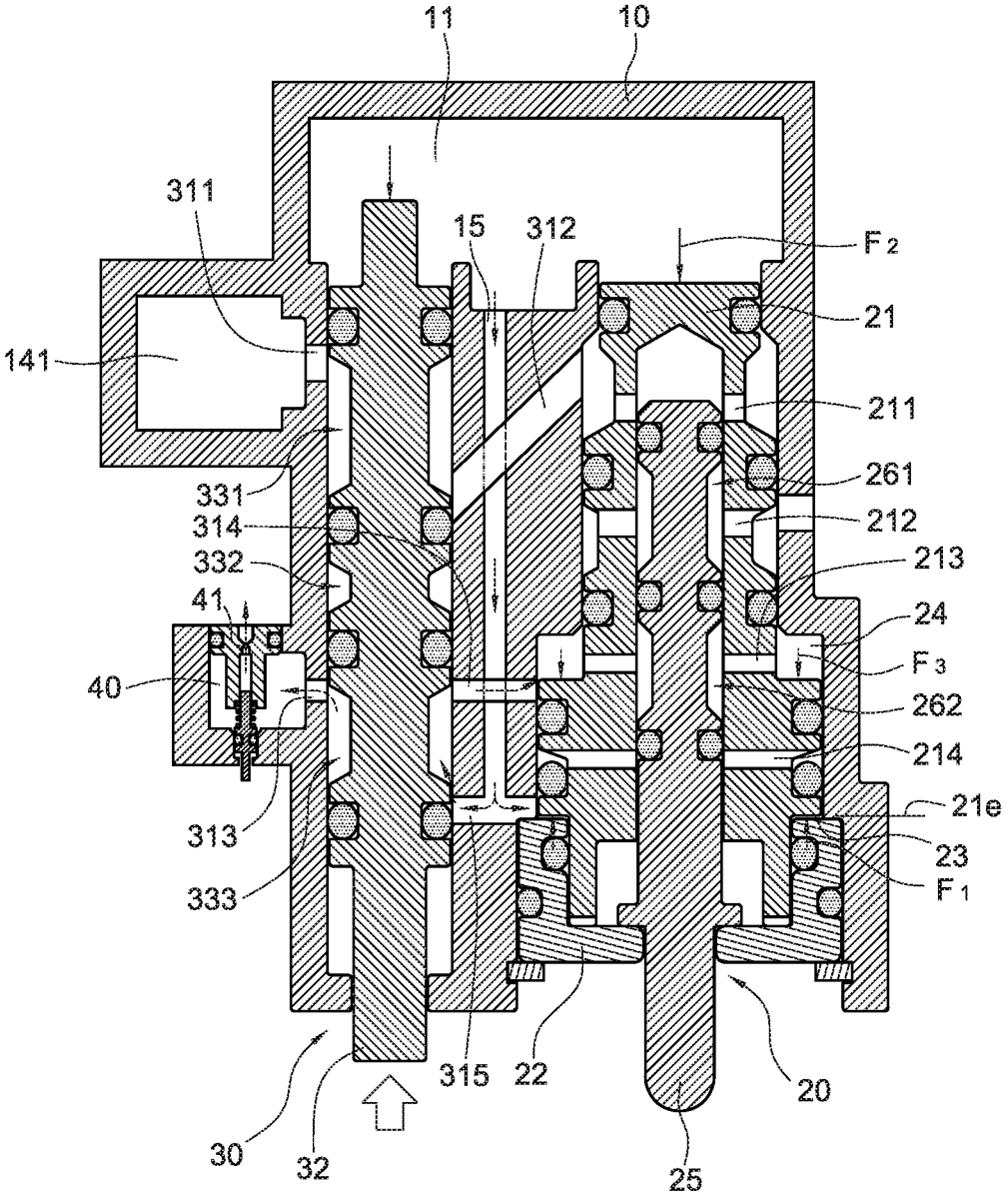

In actual implementation, the pressurized air inside the security chamber 23 forms a first thrust F1 (as shown in FIG. 3), the pressurized air inside the main chamber 11 forms a second thrust F2 (as shown in FIG. 3), the pressurized air inside the auxiliary chamber 24 forms a third thrust F3 (as shown in FIG. 4), the first thrust F1 and the second thrust F2 and the third thrust F3 respectively act on the ring-shaped shuttle valve 21, and the second thrust F2 and the third thrust F3 are respectively in a direction opposite to the first thrust F1. Specifically, the first thrust F1 acts on the first surface 21*a*, the second thrust F2 acts on the second surface 21*b*, the third thrust F3 acts on the third surface 21*c*, the first surface 21*a* has a thrust area contacting the pressurized air relatively larger than the second surface 21*b*, and the sum of the thrust areas of the third surface 21*c* and the second surface 21*b* contacting pressurized air is relatively larger than the thrust area contacting pressurized air; that is to say, as the main chamber 11 and the security chamber 23 are permanently connected, the inside of the security chamber 23 has constant concentration of pressurized air with a thrust force equal to the pressurized air inside the main chamber 11. Therefore, when the pressurized air inside the auxiliary chamber 24 is released out of the gun body 10, the first thrust F1 received by the ring-shaped shuttle valve 21 through the first surface 21*a* is relatively larger than the sum of the second thrust F2 received by the second surface 21*b* and the third thrust F3 received by the third surface 21*c* (i.e., F1>F2+F3), so that the ring-shaped shuttle valve 21 is pushed along the axial direction of the trigger valve stem 25 by the first thrust F1 to the security unlock-position 21*d* (as shown in FIG. 3); on the contrary, when pressurized air is introduced into the auxiliary chamber 24, as the first thrust F1 received by the first surface 21*a* (refer collectively to FIG. 5 and FIG. 2*a*) is relatively less than the sum of the second thrust F2 received by the second surface 21*b* and the third thrust F3 received by the third surface 21*c* (i.e., F1<F2+F3), so that the ring-shaped shuttle valve 21 is pushed along the axial direction of the trigger valve stem 25 by the second thrust F2 and the third thrust F3 to the security lock-position 21*e* (as shown in FIG. 5); In other words, through the force of the third thrust F3 formed by the pressurized air inside the auxiliary chamber 24, the ring-shaped shuttle valve 21 can be pushed to move to the security unlock-position 21*d* or the security lock-position 21*e*.

Figure 2B:
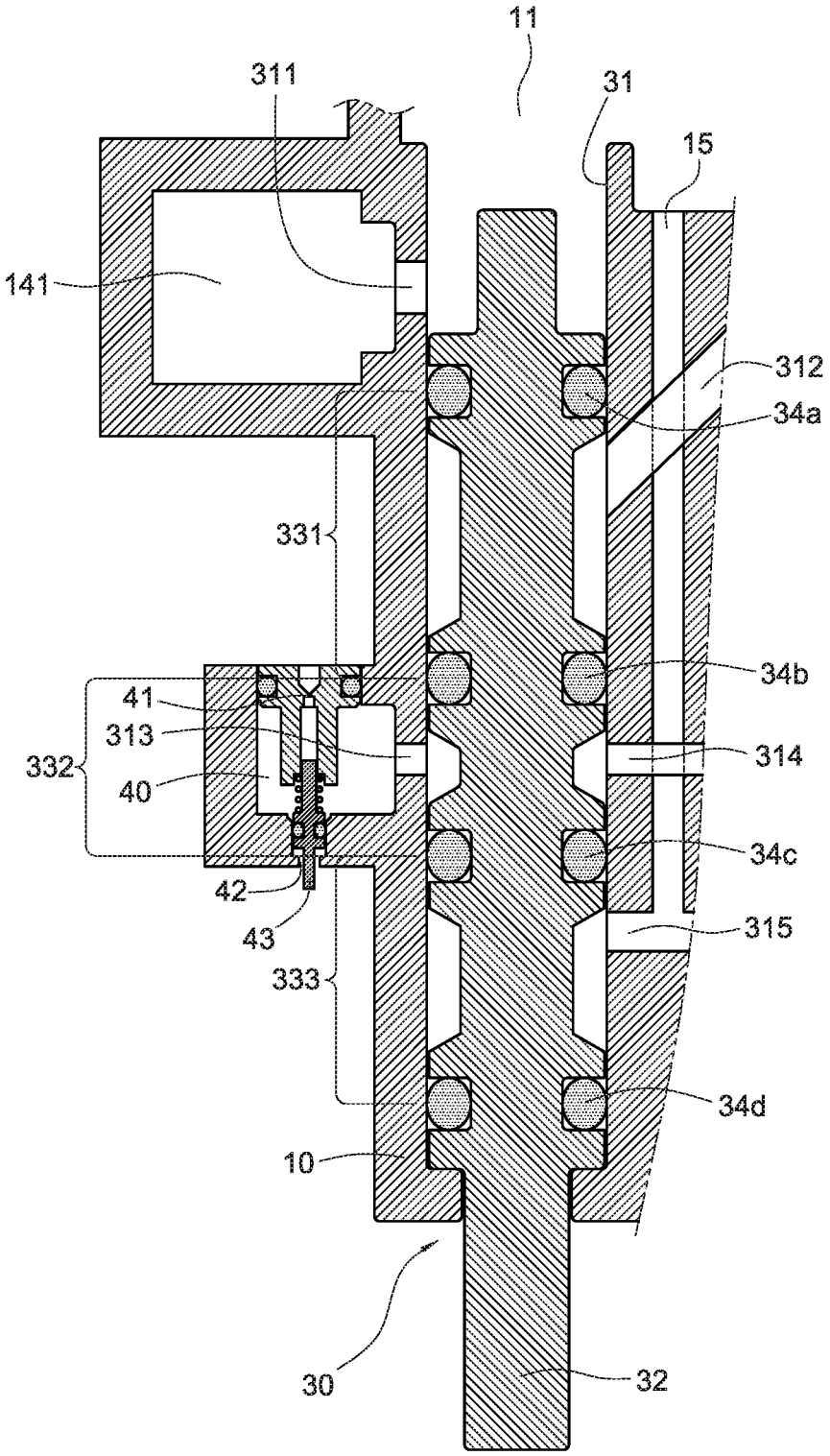

Referring to FIG. 2 and FIG. 2*b* collectively, as shown, the bar valve 30 is configured on the gun body 10, the bar valve 30 comprises a bar valve chamber 31 and a safety bar 32, wherein the bar valve chamber 31 is formed inside the gun body 10, the safety bar 32 is slidably fitted inside the bar valve chamber 31, one end of the safety bar 32 protrudes out of the gun body 10, the other end of the safety bar 32 is planted into the main chamber 11. The bar valve 30 can control the pressurized air inside the main chamber 11 to go to the piston driving chamber 141, the timekeeping chamber 40 and the auxiliary chamber 24.

One side of the gun body 10 is formed with a decompress hole 41 connected to the timekeeping chamber 40, the timekeeping chamber 40 is connected to the outside through the decompress hole 41. The sectional area of the inside of the timekeeping chamber 40 must be relatively larger than the decompress hole 41. Thus, the pressurized air concentrated inside the timekeeping chamber 40 can be continuously released to the outside. Moreover, the timekeeping chamber 40 is also configured with an exhaust hole 42 and a press-bar 43 that controls the connection of the exhaust hole 42 to the outside, the sectional area of the exhaust hole 42 is relatively larger than the decompress hole 41. When the user presses on the press-bar 43, the pressurized air inside the timekeeping chamber 40 can be quickly released to the outside through the exhaust hole 42.

Referring to FIG. 2 and FIG. 2*a* again, as shown, between the ring-shaped shuttle valve 21 and the trigger valve stem 25, a first valve part of the trigger valve 261 and a second valve part of the trigger valve 262 are formed, the ring wall of the ring-shaped shuttle valve 21 is formed with a first hole 211 connected to the bar valve 30, a second hole connected to the outside 212, a third hole 213 connected to the bar valve 30, and a fourth hole 214 connected to the bar valve 30. In actual implementation, the first hole 211, the second hole 212, the third hole 213 and the fourth hole 214 are respectively and sequentially formed on the ring wall of the ring-shaped shuttle valve 21 along the axial direction of the ring-shaped shuttle valve 21. The valve part mentioned in the present invention refers to the airflow channel formed between multiple objects.

Further, between the inner wall of the ring-shaped shuttle valve 21 and the stem wall of the trigger valve stem 25 can be configured with three O-rings 27*a*, 27*b*, 27*c*, distributed concentrically along the axial direction with appropriate intervals, wherein, between the inner wall of the ring-shaped shuttle valve 21, the stem wall of the trigger valve stem 25, O-ring 27*a* and O-ring 27*b*, the first valve part of the trigger valve 261 is formed, and between the inner wall of the ring-shaped shuttle valve 21, the stem wall of the trigger valve stem 25, O-ring 27*b* and O-ring 27*c*, the second valve part of the trigger valve 262 is formed. The time of connection between the first hole 211 and the second hole 212 is controlled by the first valve part of the trigger valve 261, and the time of connection between the third hole 213 and the fourth hole 214 is controlled by the second valve part of the trigger valve 262.

Referring again to FIG. 2 and FIG. 2*b*, as shown, between the bar valve chamber 31 and the safety bar 32, a first valve part of the bar valve 331, a second valve part of the bar valve 332 and a third valve part of the bar valve 333 are respectively formed. The wall surface of the bar valve chamber 31 is formed with a first path 311 connected to the piston driving chamber 141, a second path 312 connected to the trigger valve 20, a third path 313 connected to the timekeeping chamber 40, a fourth path 314 connected to the trigger valve 20 and a fifth path 315 connected to the main chamber 11. In actual implementation, the fifth path 315 is extended to the intake path 15 and is connected to the main chamber 11. Moreover, the second path 312 and the fourth path 314 are not connected to the intake path 15.

Further, between wall surface of the bar valve chamber 31 and the stem wall of the safety bar 32, 4 O-rings 34*a*, 34*b*, 34*c*, 34*d* can be configured concentrically along the axial direction with certain intervals, wherein, the wall surface of the bar valve chamber 31, the stem wall of the safety bar 32, O-rings 34*a* and O-ring 34*b* constitute the first valve part of the bar valve 331, the time of connection between the main chamber 11 and the first path 311 is controlled through the first valve part of the bar valve 331, the time of connection between the first path 311 and the second path 312 is controlled by the first valve part of the bar valve 331. In other words, through the control by the first valve part of the bar valve 331, the main chamber 11 and the first path 311 can be interconnected, or the first path 311 and the second path 312 can be interconnected; the wall surface of the bar valve chamber 31, the stem wall of the safety bar 32, O-ring 34*b* and O-ring 34*c* constitute the second valve part of the bar valve 332. The time of connection between the third path 313 and the fourth path 314 is controlled by the second valve part of the bar valve 332. In other words, the third path 313 and the fourth path 314 can be interconnected by the second valve part of the bar valve 332. The wall surface of the bar valve chamber 31, the stem wall of the safety bar 32, O-ring 34*c* and O-ring 34*d* constitute the third valve part of the bar valve 333. The time of connection between the third path 313, the fourth path 314 and the fifth path 315 is controlled by the third valve part of the bar valve 333. In other words, through the control by the third valve part of the bar valve 333, the third path 313, the fourth path 314 and the fifth path 315 can be interconnected.

Referring sequentially to the figures from FIG. 3 to FIG. 8, when the pneumatic nail gun is in the initial state (as shown in FIG. 3), i.e., the user has not pressed the trigger valve stem 25 and the safety bar 32 on the pneumatic nail gun, the pressurized air inside the main chamber 11 will go through the intake path 15 into the security chamber 23 and be constantly concentrated, and pressurized air inside the auxiliary chamber 24 has been released, thus the first thrust F1 is larger than the sum of the second thrust F2 and the third thrust F3 (i.e., F1>F2+F3), the ring-shaped shuttle valve 21 will be pushed by the first thrust F1 to the security unlock-position 21*d*, causing the first valve part of the trigger valve 261 to close the passage from the first hole 211 to the second hole 212, and the pressurized air inside the piston driving chamber 141 can not be released out of the gun body 10 through the trigger valve 20; at the same time, the pressurized air inside the main chamber 11 goes through the first path 311 on the bar valve chamber 31 and enters the piston driving chamber 141.

Further, when the user presses the safety bar 32 (as shown in FIG. 4), the first valve part of the bar valve 331 closes the passage from the main chamber 11 to the first path 311 and opens the passage from the first path 311 to the second path 312, so that the pressurized air inside the main chamber 22 cannot enter the piston driving chamber 141; at the same time, the third valve part of the bar valve 333 opens the passages between the third path 313, the fourth path 314 and the fifth path 315, so that the pressurized air inside the main chamber 11 will go through the intake path 15 into the security chamber 23, meanwhile, it goes through the fifth path 315, the third valve part of the bar valve 333, and the third path 313 into the timekeeping chamber 40, and through the fifth path 315, the third valve part of the bar valve 333, the fourth path 314, the fourth hole 214, the second valve part of the trigger valve 262, and the third hole 213 into the auxiliary chamber 24. As the timekeeping chamber continuously releases the pressurized air to the outside, the first thrust F1 is less than the sum of the second thrust F2 and the third thrust F3 (i.e., F1<F2+F3), so that the ring-shaped shuttle valve 21 is pushed by the second thrust F2 and the third thrust F3 to the security lock-position 21*e* (as shown in FIG. 5). After the ring-shaped shuttle valve 21 has moved to the security lock-position 21*e*, the original pressurized air going from the main chamber 11 through the fifth path 315, the third valve part of the bar valve 333, the fourth path 314, the fourth hole 214, the second valve part of the trigger valve 262, and the third hole 213 into the auxiliary chamber 24 will directly go through the fifth path 315, the third valve part of the bar valve 333, and the fourth path 314 into the auxiliary chamber 24.

Figure 6:
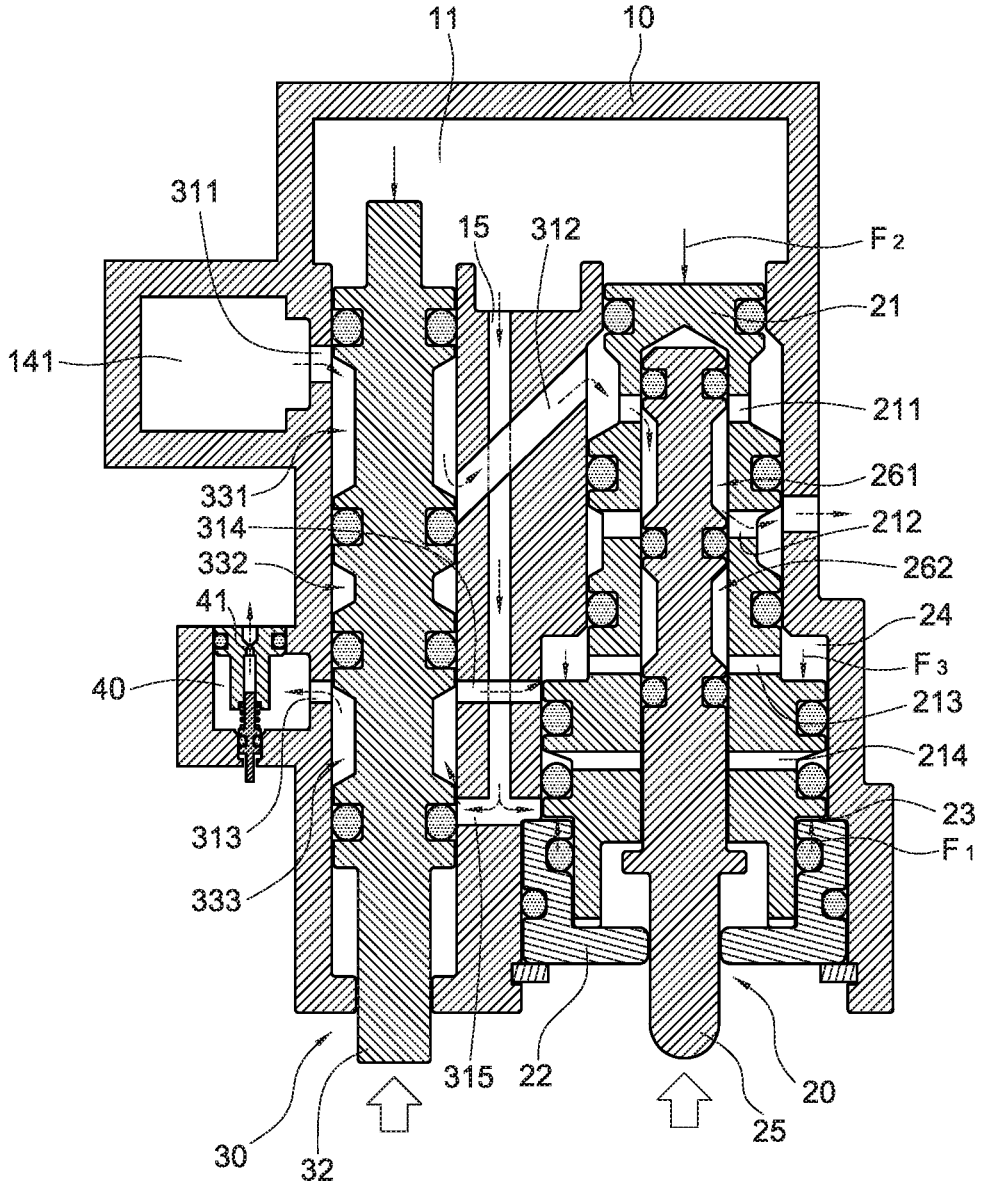

Then, after the user presses the safety bar 32 and keeps the pressing while further pressing the trigger valve stem 25 (as shown in FIG. 6), the first valve part of the trigger valve 261 will open the passage from the first hole 211 to the second hole 212, so that the pressurized air inside the piston driving chamber 141 will go through the first path 311, the first valve part of the bar valve 331, the second path 312, the first hole 211, the first valve part of the trigger valve 261, the second hole 212 and be released out of the gun body 10.

Figure 7:
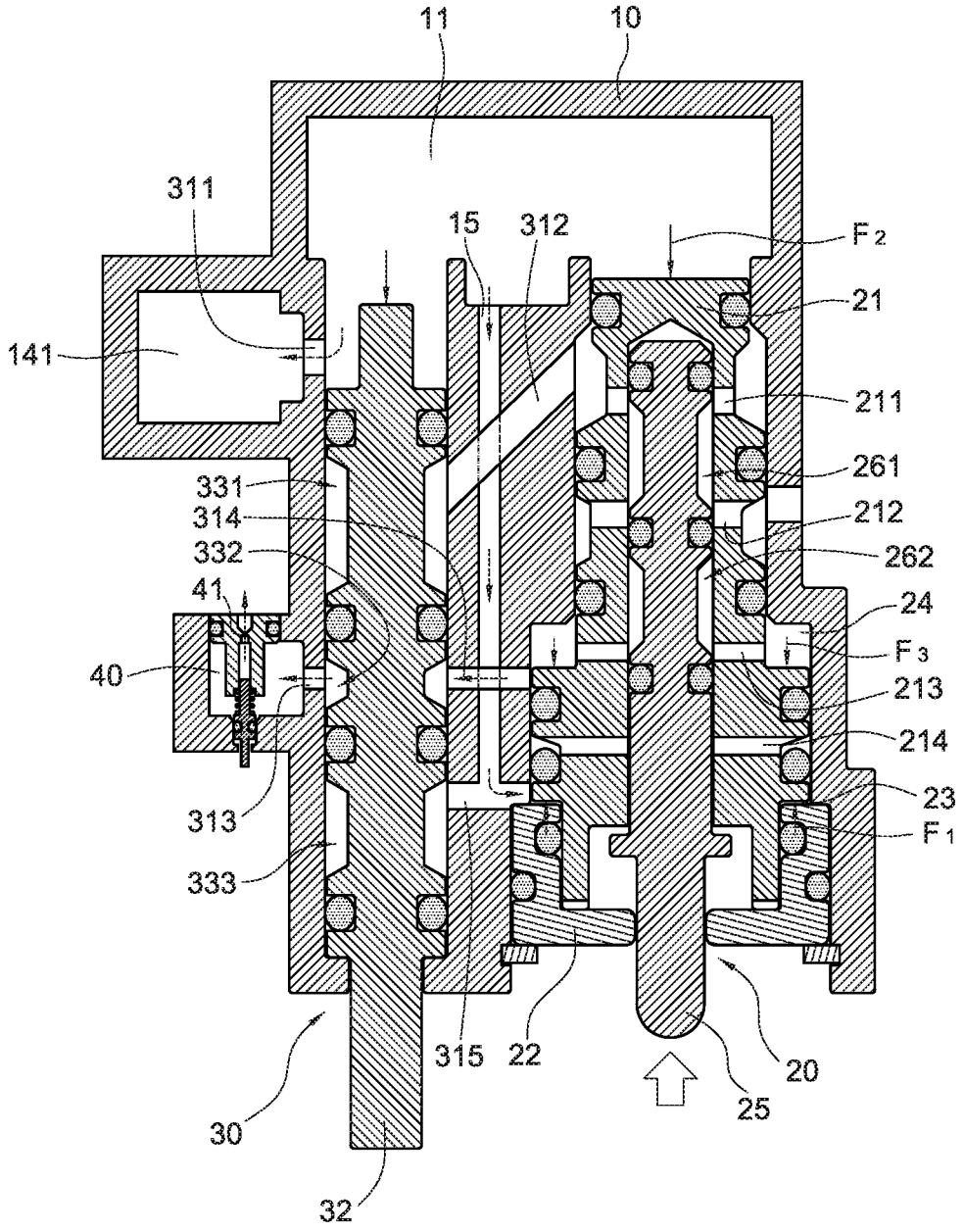
Figure 8:
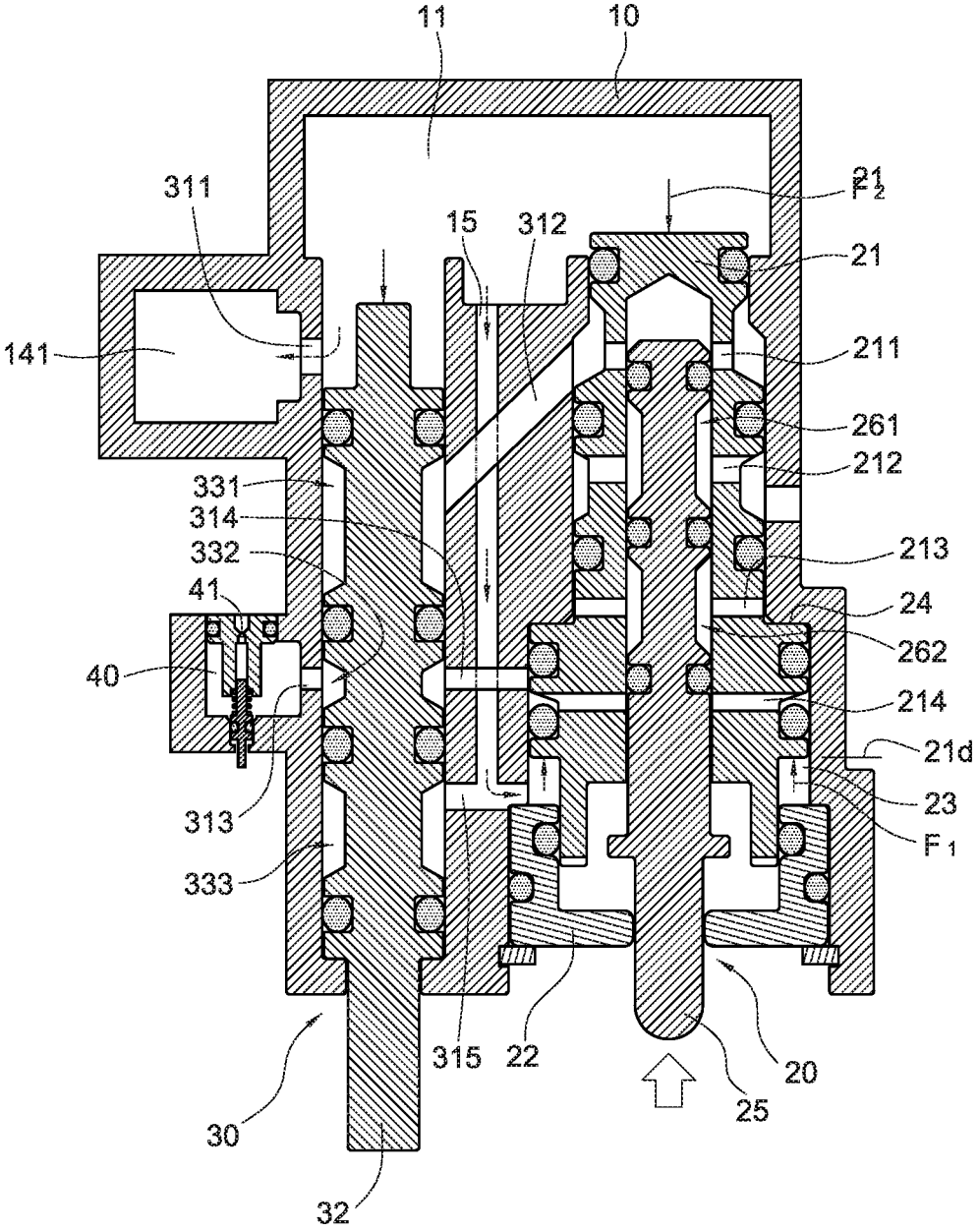

At last, when the user presses the trigger valve stem 25, keeps the pressing and releases the safety bar 32 (as shown in FIG. 7), the first valve part of the bar valve 331 will open the passage from the main chamber 11 to the first path 311 and close the passage from the first path 311 to the second path 312, so that the pressurized air inside the main chamber 11 can enter the piston driving chamber 141. At the same time, the third valve part of the bar valve 333 will close the passages between the third path 313, the fourth path 314 and the fifth path 315, and the second valve part of the bar valve 332 will open the passage from the third path 313 to the fourth path 314, so that the pressurized air inside the main chamber 11 cannot enter the timekeeping chamber 40 and the auxiliary chamber 24, causing the pressurized air inside the auxiliary chamber 24 to go through the fourth path 314, the second valve part of the bar valve 332, the third path 313 into the timekeeping chamber 40, and be released to the outside. As the security chamber 23 has constant concentration of the pressurized air from the main chamber 11, while the pressure inside the auxiliary chamber 24 decreases due to the release (third thrust F3 decreases), the first thrust F1 is larger than the sum of the second thrust F2 and the third thrust F3 (i.e., F1>F2+F3), so that the ring-shaped shuttle valve 21 is pushed by the first thrust F1 to the security unlock-position 21*d* (as shown in FIG. 8); in addition, when the user releases the safety bar 32 and then releases the trigger valve stem 25, if the safety bar 32 has not been pressed within a specific period of time (e.g., more than 10 seconds), because the third valve part of the bar valve 333 has closed the passages between the third path 313, the fourth path 314 and the fifth path 315, and the second valve part of the bar valve 332 has opened the passage from the third path 313 to the fourth path 314, the pressurized air inside the main chamber 11 cannot enter the timekeeping chamber 40 and the auxiliary chamber 24, so that the pressure inside the security chamber 23 will increase, the pressure inside the auxiliary chamber 24 will decrease. The first thrust F1 is larger than the sum of the second thrust F2 and the third thrust F3 (i.e., F1>F2+F3), so that the ring-shaped shuttle valve 21 is pushed by the first thrust F1 to the security unlock-position 21*d* (as shown in FIG. 3). In other words, whether the user presses the trigger valve stem 25 or not, as long as the safety bar 32 has not been pressed within a specific period of time, the ring-shaped shuttle valve 21 will move to the security unlock-position 21*d*, so that the pneumatic nail gun cannot shoot nails.

Figure 9:
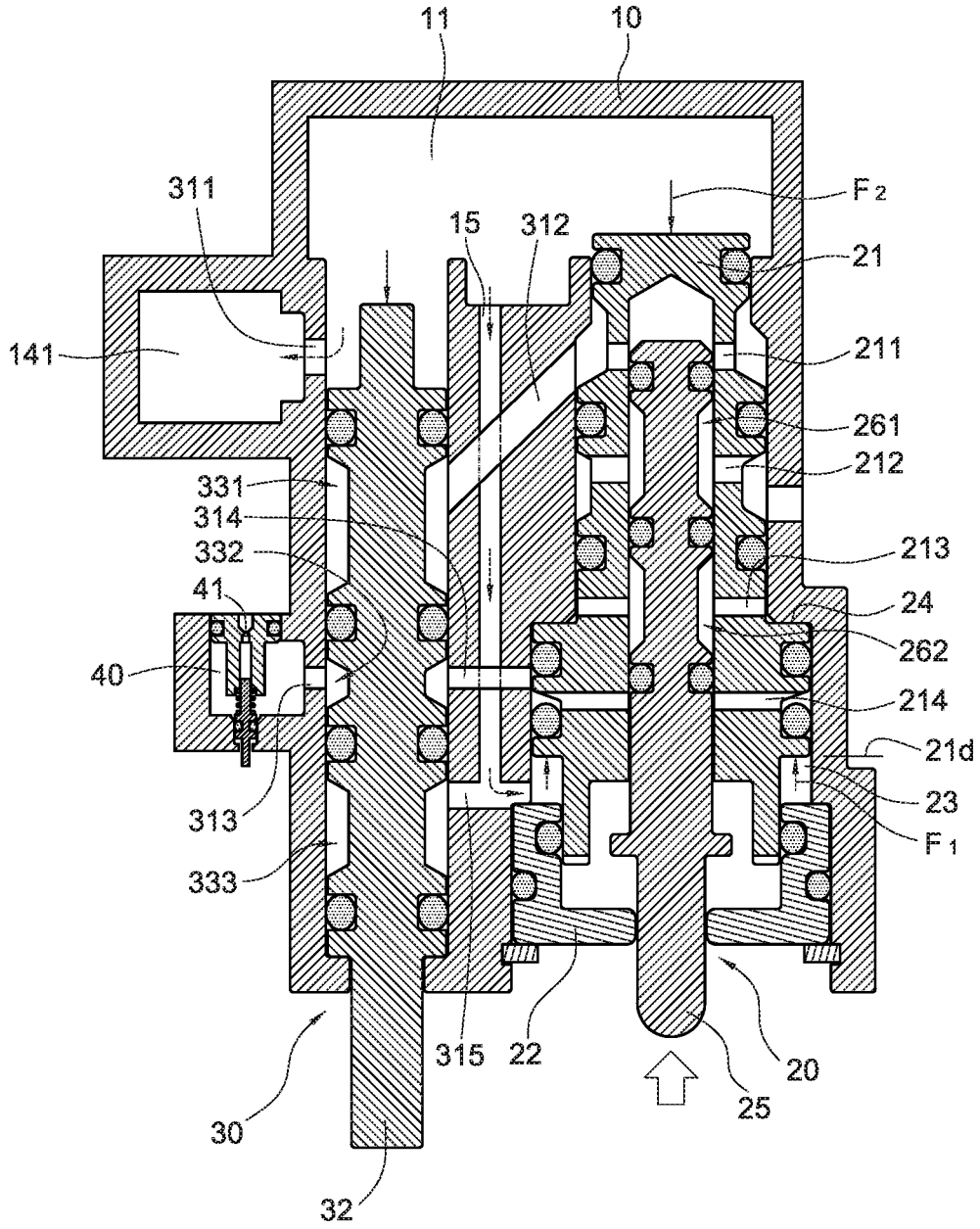
FIG. 9 to FIG. 10 are sequentially the explanation figures showing the continuous actions firstly compressing the trigger valve stem and then pressing the safety bar.
Figure 10:
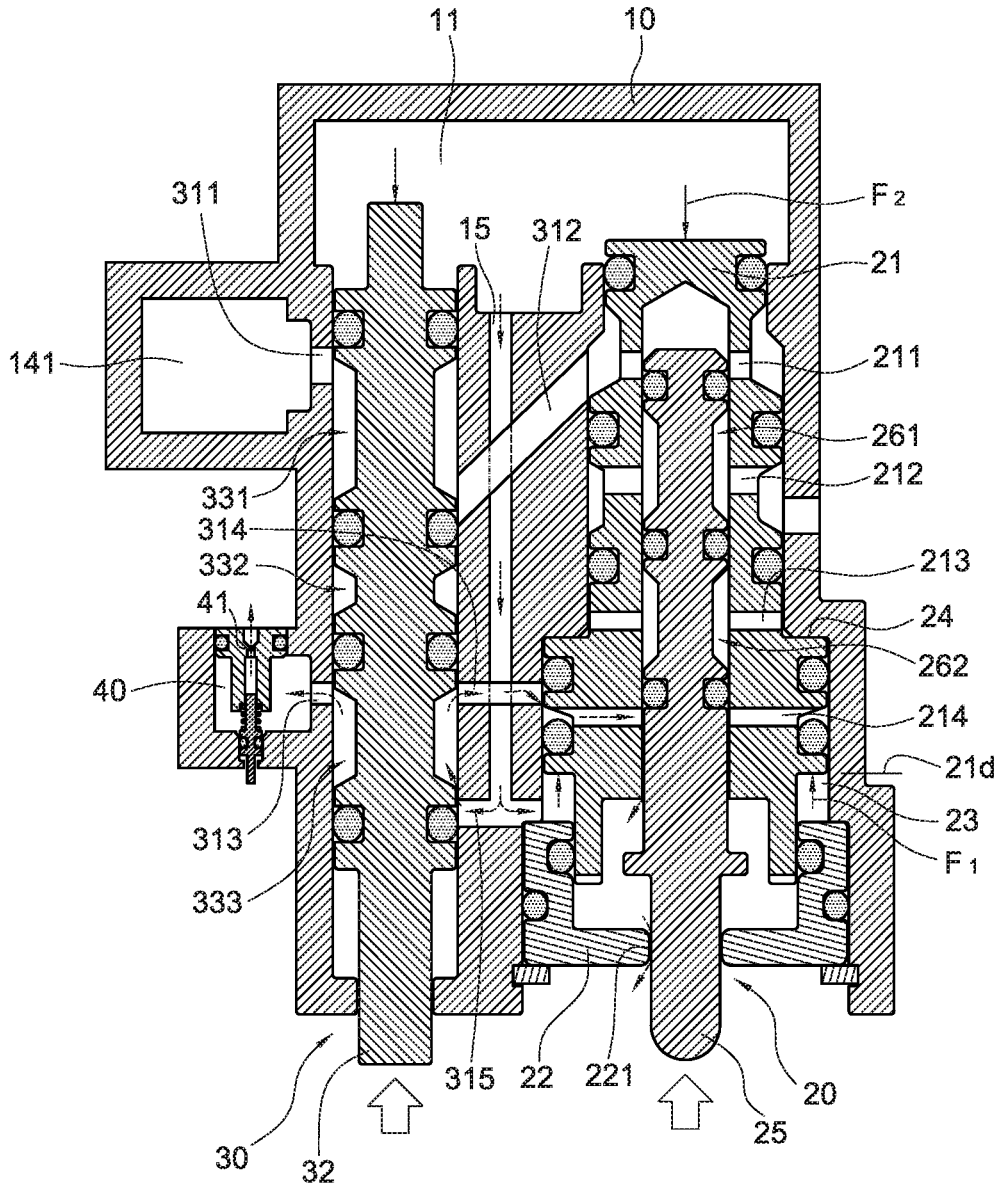

Referring sequentially to the figures from FIG. 9 to FIG. 10, in the initial state of the pneumatic nail gun, if the trigger valve stem 25 (as shown in FIG. 9) is firstly pressed, as the third valve part of the bar valve 333 has closed the passages between the third path 313, the fourth path 314 and the fifth path 315, the pressurized air inside the main chamber 11 cannot enter the timekeeping chamber 40, and the ring-shaped shuttle valve 21 is maintained at the security unlock-position 21*d*. Then, when the user keeps pressing the trigger valve stem 25 without releasing and then presses the safety bar 32 (as shown in FIG. 10), as the ring-shaped shuttle valve 21 is maintained at the security unlock-position 21*d*, the first valve part of the trigger valve 261 will close the passage from the first hole 211 to the second hole 212, so that the pressurized air inside the piston driving chamber 141 cannot go through the first path 311, the first valve part of the bar valve 331, the second path 312, the first hole 211, the first valve part of the trigger valve 261, the second hole 212 and be released out of the gun body 10. At the same time, the pressurized air inside the main chamber 11 is blocked by the O-ring 27*c* and can not go through the fifth path 315, the third valve part of the bar valve 333, the fourth path 314, the fourth hole 214, the second valve part of the trigger valve 262, the third hole 213 and into the auxiliary chamber 24, instead, it is released to the outside through the stem hole 221, so that the thrust force formed by the pressurized air inside the auxiliary chamber 24 cannot drive the ring-shaped shuttle valve 21 to move toward the security lock-position 21*e*. In other words, the user must abide by the sequential actuation mode, i.e., firstly press the safety bar 32 to cause the ring-shaped shuttle valve 21 to move to the security lock-position 21*e*, before starting the nail shooting.

Although the invention has been explained in relation to its preferred embodiment, it is to be understood that many other possible modifications and variations can be made without departing from the spirit and scope of the invention as hereinafter claimed.

The invention claimed is:

1. An air-path structure of pneumatic nail gun, comprising:

a gun body, a main chamber located inside the gun body and configured to concentrate pressurized air, a piston driving chamber and a timekeeping chamber that is configured to continuously release the pressurized air to the outside;

a trigger valve, configured on the gun body, wherein the trigger valve comprises a ring-shaped shuttle valve, a security chamber and an auxiliary chamber, the two ends of the ring-shaped shuttle valve are respectively exposed in the security chamber and the main chamber, and the ring-shaped shuttle valve goes through the auxiliary chamber, the pressurized air inside the security chamber forms a first thrust, the pressurized air inside the main chamber forms a second thrust, the pressurized air inside the auxiliary chamber forms a third thrust; the first thrust, the second thrust and the third thrust respectively act on the ring-shaped shuttle valve, and the second thrust and the third thrust are respectively in a direction opposite to the direction of the first thrust, the trigger valve is configured to control the pressurized air inside the piston driving chamber to be released out of the gun body through the ring-shaped shuttle valve;

a bar valve, configured on the gun body, wherein the bar valve is configured to control the pressurized air inside the main chamber to enter the piston driving chamber, the timekeeping chamber and the auxiliary chamber;

wherein, the security chamber is permanently connected to the main chamber and is configured to concentrate the pressurized air, and when the bar valve is configured to control the pressurized air inside the auxiliary chamber to go to the timekeeping chamber and to be released continuously to the outside, the first thrust is configured to be larger than the sum of the second thrust and the third thrust, so as to drive the ring-shaped shuttle valve to move to a security unlock-position;

when the pressurized air inside the main chamber goes to the auxiliary chamber through the bar valve, the sum of the third thrust and the second thrust formed by the pressurized air concentrated inside the auxiliary chamber is configured to be larger than the first thrust, so as to drive the ring-shaped shuttle valve to move from the security unlock-position to a security lock-position.

2. The air-path structure of pneumatic nail gun defined in claim 1, wherein the inside of the gun body is formed with an intake path extending between the main chamber and the security chamber, and the intake path is configured to guide the pressurized air from the main chamber to the security chamber.

3. The air-path structure of pneumatic nail gun defined in claim 2, wherein the trigger valve also comprises a trigger valve seat and a trigger valve stem, the trigger valve seat is located at the bottom of the trigger valve, and is fitted on the gun body, the trigger valve stem goes through the trigger valve seat and is planted into the ring-shaped shuttle valve, the security chamber is formed between the ring-shaped shuttle valve and the trigger valve seat, the auxiliary chamber is formed between the gun body and the ring-shaped shuttle valve.

4. The air-path structure of pneumatic nail gun defined in claim 3, wherein the ring-shaped shuttle valve has a first surface, a second surface and a third surface, the first surface is exposed in the security chamber, the second surface is exposed in the main chamber, the third surface is exposed in the auxiliary chamber, the first surface has a thrust area contacting the pressurized air relatively larger than that of the second surface, and the sum of the thrust area of the second surface and the third surface contacting the pressurized air is relatively larger than the first surface.

5. The air-path structure of pneumatic nail gun defined in claim 3, wherein between the ring-shaped shuttle valve and the trigger valve stem, a first valve part of the trigger valve and a second valve part of the trigger valve are formed, the ring wall of the ring-shaped shuttle valve is formed with a first hole that is connected to the bar valve, a second hole that is connected to the outside, a third hole that is connected to the bar valve and a fourth hole that is connected to the bar valve, the time of connection between the first hole and the second hole is controlled by the first valve part of the trigger valve, and the time of connection between the third hole and the fourth hole is controlled by the second valve part of the trigger valve.

6. The air-path structure of pneumatic nail gun defined in claim 5, wherein the first valve part of the trigger valve and the second valve part of the trigger valve are respectively formed between the ring-shaped shuttle valve and the trigger valve stem sequentially along the axial direction of the ring-shaped shuttle valve, the first hole, the second hole, the third hole and the fourth hole are respectively formed on the ring wall of the ring-shaped shuttle valve sequentially along the axial direction of the ring-shaped shuttle valve.

7. The air-path structure of pneumatic nail gun defined in claim 1, wherein the inside of the gun body is formed with a bar valve chamber, the bar valve comprises a safety bar slidably fitted in the bar valve chamber, one end of the safety bar protrudes out of the gun body, and the other end of the safety bar is planted inside the main chamber.

8. The air-path structure of pneumatic nail gun defined in claim 7, wherein between the bar valve chamber and the safety bar, a first valve part of the bar valve, a second valve part of the bar valve and a third valve part of the bar valve are respectively formed, the wall surface of the bar valve chamber is formed with a first path connected to the piston driving chamber, a second path connected to the trigger valve, a third path connected to the timekeeping chamber, a fourth path connected to the trigger valve and a fifth path connected to the main chamber, the time of connection between the main chamber and the first path is controlled by the first valve part of the bar valve, and the time of connection between the first path and the second path is controlled by the first valve part of the bar valve, the time of connection between the third path and the fourth path is controlled by the second valve part of the bar valve, the time of connection between the third path, the fourth path and the fifth path is controlled by the third valve part of the bar valve.

9. The air-path structure of pneumatic nail gun defined in claim 8, wherein the first valve part of the bar valve, the second valve part of the bar valve and the third valve part of the bar valve are respectively and sequentially formed between the bar valve chamber and the safety bar along the axial direction of the bar valve chamber, the first path, the second path, the third path, the fourth path and the fifth path are respectively and sequentially formed on the wall surface of the bar valve chamber along the axial direction of the bar valve chamber.

10. The air-path structure of pneumatic nail gun defined in claim 1, wherein one end of the gun body is formed with a decompress hole connected to the timekeeping chamber, and the timekeeping chamber is configured to continuously release the pressurized air to the outside through the decompress hole.

11. The air-path structure of pneumatic nail gun defined in claim 10, wherein the sectional area of the timekeeping chamber is relatively larger than the decompress hole.

12. The air-path structure of pneumatic nail gun defined in claim 10, wherein one end of the gun body is also formed with an exhaust hole connected to the timekeeping chamber and a press-bar that is configured to control the connection of the exhaust hole to the outside, the sectional area of the exhaust hole is relatively larger than the decompress hole.

* * * * *